United States Patent [19]

Tomashauer et al.

[11] Patent Number: 4,976,803

[45] Date of Patent: Dec. 11, 1990

[54] APPARATUS FOR PRESSING FOIL ON CONTAINERS, SUCH AS ON THE TOPS AND THE NECKS OF BOTTLES OR THE LIKE

[75] Inventors: Josef Tomashauer, Willich; Rudolf Zodrow; Rainer Buchholz, both of Düsseldorf, all of Fed. Rep. of Germany

[73] Assignee: ETI-TEC Maschinenbau GmbH, Erkrath, Fed. Rep. of Germany

[21] Appl. No.: 311,609

[22] Filed: Feb. 15, 1989

[30] Foreign Application Priority Data

Feb. 19, 1988 [DE] Fed. Rep. of Germany ..... 3805188
Oct. 5, 1988 [DE] Fed. Rep. of Germany ..... 3833850

[51] Int. Cl.[5] ..... B65C 3/00; B65C 9/00

[52] U.S. Cl. ..... 156/297; 156/476; 156/489; 156/567; 156/DIG. 14; 156/DIG. 16

[58] Field of Search ..... 156/476, 567, DIG. 16, 156/DIG. 15, 477.1, 486, 489, 490, 491, 357, DIG. 14

[56] References Cited

U.S. PATENT DOCUMENTS 4,414,056 11/1983 Buchholz et al. ..... 156/476
4,536,247 8/1985 Buchholz et al. ..... 156/477.1
4,613,397 9/1986 Buchholz ..... 156/476

FOREIGN PATENT DOCUMENTS 3104807 7/1982 Fed. Rep. of Germany .
3515730 11/1986 Fed. Rep. of Germany .

*Primary Examiner*—Caleb Weston
*Assistant Examiner*—Chester T. Barry
*Attorney, Agent, or Firm*—Nils H. Ljungman & Associates

[57] ABSTRACT

This invention relates to a pressing station for metal foil sheets applied around the top and neck of bottles. By means of bell-shaped pressing elements which can be axially lowered toward the bottle top, the foil sheets are firmly applied to the top and neck of the bottle. The pressing elements corresponding to each receiving position of the delivery star wheel are each supported by a crank. By means of a three-dimensional drive mechanism, each crank and thus also each pressing element can be lowered to the top of a bottle. To prevent collisions in the overlapping area of the rotational paths of the turntable and the delivery star wheel, each crank is coupled with another drive mechanism, which engages the crank. The cams of the two cam drive mechanisms are designed so that the pressing element is in its raised inside position in the vicinity of the turntable, and in its lowered, outside position in a portion of the area between the turntable and the delivery of the delivery star wheel.

19 Claims, 5 Drawing Sheets

APPARATUS FOR PRESSING FOIL ON CONTAINERS, SUCH AS ON THE TOPS AND THE NECKS OF BOTTLES OR THE LIKE

BACKGROUND OF THE INVENTION

1. Field of the Invention:

This invention relates to a pressing station for metal foil sheets placed around the top and the neck of bottles in a labelling machine with a transfer station located on the turntable for the bottles which transfers the metal foil sheets to the bottles, and a delivery star wheel, in which corresponding to each receiving spot for the bottles there is a bell-shaped pressing element which can be moved axially by a cam controlled drive mechanism toward the bottle top, wherein the pressing element is held by a support located above the delivery star wheel and which rotates with the delivery star wheel.

2. Description of the Prior Art:

On such pressing stations, the rotating paths of the delivery positions of the turntable and of the delivery star wheel overlap, so that the bottles can be transferred in synchronization from the turntable to the delivery star wheel. Since during transport of the bottles both in the turntable and in the delivery star wheel, elements grip the top of the bottle, namely centering heads when the bottle is on the turntable and pressing elements when the bottle is in the delivery star wheel, it is difficult to achieve a collision-free fit of the elements of the turntable and of the delivery star wheel in the overlapping region. Since for purposes of a transfer of the bottles from the turntable to the delivery star wheel at the proper angle of rotation, the bottles in the turntable must be held as long as possible in a rotation-free manner by axial bracing between the turntable which supports the bottom of the bottle, and a centering element which grips the top, for a collision-free passage of the pressing elements of the delivery star wheel, it is necessary to move these pressing elements out of the overlapping area during the passage.

In a pressing station of the prior art (German Laid Open Patent Appln. No. 31 04 807 C2, which corresponds to U.S. Pat. No. 4,414,056 the disclosure of which is incorporated herein by reference), this problem is approached by equipping each pressing element so that it can pivot to one side from its position above the receiving position, into a position which lies outside the portion of the turntable traversed by the centering head of the turntable. Only when the pressing element has passed the overlapping area can it be pivoted over the bottle top of the corresponding receiving position, and then lowered to press the foil sheet. One disadvantage of such pressing stations is that a great deal of space is required for the pivoting movement, and the drive and transmission mechanisms required for the pivoting motion and the subsequent axial movement are quite complex and expensive.

These disadvantages related to the pivoting movement do not occur on another pressing station of the prior art (German Laid Open Patent No. 35 15 730 A1, the disclosure of which is incorporated herein by reference), in which the pressing elements are located so that they pivot on the circumference of a support, which has a smaller diameter than that of the delivery star wheel, and is mismatched in relation to the delivery star wheel such that the path of the pressing elements lies outside the path of the receiving positions of the turntable, and only above a short segment of the path of the receiving positions of the delivery star wheel. A disadvantage, however, is that synchronization between the receiving positions of the delivery star wheel and the pressing elements can only be achieved over the above-mentioned short segment, and then only approximately, which has a negative effect on the quality of the pressing of the foil sheet.

On both pressing stations of the prior art, however, a collision-free passage of the pressing elements on the delivery star wheel and the centering heads on the turntable or synchronization between the receiving positions of the delivery star wheel and the pressing elements is only guaranteed during operation when there is no daming up at the outlet of the delivery star wheel. To prevent major damage to the pressing station when there is a jamming up at the outlet of the delivery star wheel, the delivery star wheel is coupled in pressing stations used in practice with the drive by means of a slip clutch. If a jamming up does occur, then the delivery star wheel can slip in relation to the drive. In the first pressing station of the prior art described above, that leads to pivotable pressing elements which are oriented concentrically to the receiving positions, so that the synchronization between the turntable and the pressing elements is lost. When rotation continues, therefore, even with the pressing elements pivoted back, collisions occur. In the other pressing station of the prior art described above, with the support for the pressing elements offset and not torsionally connected to the delivery star wheel, a slipping of the delivery star wheel in relation to the drive as a result of a jam leads to an offset between the receiving positions and the pressing elements corresponding to the receiving positions in the pressing area. Once again, the result is that the pressing elements can no longer be placed centrally over the bottle tops.

OBJECT OF THE INVENTION

The object of the invention is to create a pressing station which has a compact construction, a simple drive mechanism, and in which the pressing of the foil sheets is performed in synchronization.

SUMMARY OF THE INVENTION

This object is achieved by the invention with a pressing station of the type described above in which the pressing element is supported by the free end of a rocker which can be adjusted in an axial plane, as its other end moves axially, when the pressing elements rotate around the axis of the delivery star wheel, by means of a three-dimensional cam drive mechanism, and whose free end is moved radially by a cam drive mechanism coupled with the rocker as a function of the axial movement of the rocker, whereby the cams of the two cam drive mechanisms are designed such that the pressing element is in its upper inside position in the vicinity of the turntable, and in its lower outside position in a portion of the region between the turntable and the output of the delivery star wheel. Very little space is thereby occupied by a design in which the rocker is part of a duplex crank, whose coupling element supports the pressing element and whose fixed link is moved axially by the three-dimensional cam drive mechanism.

With the invention, even if there is a slipping of the delivery star wheel and the torsionally connected support for the pressing elements, there cannot be a collision in the vicinity of the turntable with the centering elements, because in the radial inside position determined by the fixed cam of the three-dimensional cam drive mechanism, the pressing elements lie outside the path of the centering elements or of the bottles braced by them. Nor can there be a rotational offset between the receiving positions of the delivery star wheel and the corresponding pressing elements, because the delivery star wheel and supports of the pressing elements are torsionally connected to one another. On account of the exclusively radial and axial control of the pressing elements in an axial plane, the pressing element and corresponding receiving position remain properly oriented in relation to one another.

The three-dimensional cam drive mechanism coupled with the rocker preferably has a cam comprising several segments, where the first segment which becomes active during the descending movement has at least one radial control component, and where the segment which becomes active during the pressing of the foil sheet has only one axial component. Also, according to another configuration of the invention, the cams of the two cam drive mechanisms are designed so that an initially slow descent of the rocker corresponds to a large radial movement This configuration avoids stress peaks.

The cam of the three-dimensional cam drive mechanism is preferably located on a drum jacket surface, in particular a cylindrical one. The cam located on the drum jacket surface can thereby be designed as a support cam for the engagement element of the three-dimensional cam drive mechanism, which absorbs the axial reaction force of the pressing element on the bottle top.

In one configuration of the invention, the rocker is part of a duplex crank, whose coupling element supports the pressing element and whose fixed link is axially moved by the three-dimensional cam drive mechanism. The duplex crank is preferably a parallel crank. A particularly elegant design solution is to have the rockers braced against one another in their outer radial position. Without any additional abutments, such a design achieves a rigid structure which is capable of absorbing the axial forces during pressing. If the cam of the three-dimensional cam drive mechanism is designed as a one-sided support cam for the engagement element, one configuration of the invention specifies that the rocker is pre-stressed by a spring which presses the engagement element against the support cam. The advantage of fabricating one-sided support cams is therefore offset against the additional expense of a spring, which keeps the engagement element in contact with the support cam.

This additional expense can be eliminated if, according to an alternative configuration of the invention, the cam of the three-dimensional cam drive mechanism, which consists of a cam segment lying in a radial plane and a three-dimensional cam segment extending over several radial planes, is designed on the inside in the form of a drum-shaped support, whereby the plane cam segment is designed as a closed slot cam and the three-dimensional cam segment as a radially open slot cam. This configuration of the invention has the advantage that the engagement element is precisely guided over its entire path even without a spring. The fabrication of the cams is still relatively simple, because the plane groove cam can still be fabricated with a conventional cylinder milling machine from the inside of the drum-shaped support, while the three-dimensional cam segment can be fabricated externally with an end milling cutter.

In an alternative configuration of the rocker, instead of as a duplex crank, it can be designed as a one-armed lever, on which the pressing element is rigidly fastened. While with the duplex crank, there is a parallel offset of the pressing element between the radially outer and the radially inside position, in this configuration the pressing element is oriented from axis to bottle axis only in the radially outer position, and not while it is pivoted in its radially inside position. That is not critical, since in the radially inside position the pressing element has no function to perform. The advantage of this configuration is that its design is significantly simpler than that of a parallel crank.

In summing up, the invention includes a pressing station for foil sheets applied around the top and neck of bottles in a labelling machine. The labelling machine has a foil sheet transfer station located along a turntable for the bottles which transfers the foil sheets to the bottles. It also includes a delivery star wheel in which, corresponding to each receiving spot for the bottles located on its circumference, there is a bell-shaped pressing element, alternatively known as means for pressing, which can be moved by a cam controlled drive mechanism axially toward the bottle top, and wherein the pressing element is held by a support located above the delivery star wheel which rotates with the delivery star wheel. The pressing station comprises operative means for moving a pressing element supported on the free end of a rocker which can be adjusted in an axial plane. The other end is moved axially during the rotation of the pressing element around the axis of the delivery star wheel by a three-dimensional cam drive mechanism, and the free end is moved radially by a cam drive mechanism coupled with the rocker, as a function of the axial movement of the rocker. The cams of the two cam drive mechanisms are designed so that the pressing element is in its raised inside position in the vicinity of the turntable and is in its lower outside position in a portion of the region between the turntable and the delivery of the delivery star wheel.

Another embodiment of the invention includes an apparatus which is for pressing attached foil sheets around the top and neck of bottles. The apparatus includes an arrangement for transporting the bottles and foil sheets along a predetermined path of travel to a transfer station. Also included is an arrangement for transporting the bottles and foil sheets along a predetermined path of travel from the transfer station to a pressing station. An arrangement in the pressing station is included for pressing the foil sheets around the top and neck of the bottles. The arrangement for pressing the foil sheets comprises an operative arrangement for moving the foil pressing arrangement transversely, with respect to the path of travel of the bottles to the pressing station, from a retracted position out of the predetermined paths of travel to an extended position above the top of the bottles.

Yet another embodiment of the invention includes a method for pressing attached foil sheets around the top and neck of bottles. The method comprises the steps of transporting the bottles and foil sheets along a predetermined path of travel to a transfer station. Next, the bottles and foil sheets are transported along a predetermined path of travel from the transfer station to a pressing station. Finally, the foil pressing arrangement is moved transversely with respect to the path of travel of the bottles to the pressing station, from a retracted position out of the predetermined paths of travel to an extended position above the top of the bottles.

The invention is explained in greater detail below with reference to the accompanying drawings.

DESCRIPTION OF THE PREFERRED EMBODIMENTS

Figure 1:
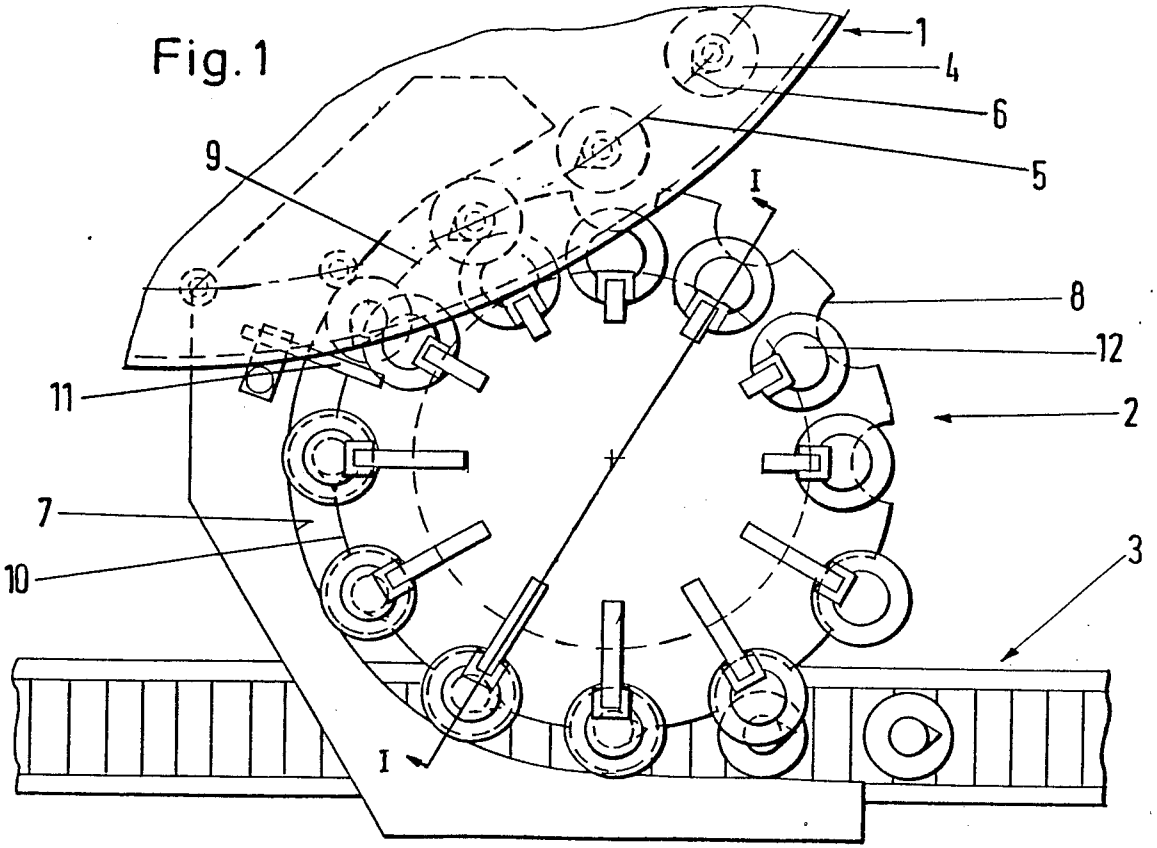
FIG. 1 shows a pressing station as part of a labelling machine, schematically and in a plan view.

FIG. 1 is a schematic illustration of a labelling machine, showing only a turntable 1, a delivery star wheel 2 and a plate or platform conveyor belt 3. On bottles 4 which are transported by the turntable 1 on a circular transport path 5, foil sheets 6 are applied by a transfer station located in a fixed position on the transport path 5, but not shown, and are then pressed against the neck of the bottle by brushes, also not shown. Since the bottles 4 during this transport are held in place by centering heads which engage the top of the bottle, the foil sheets 6 cannot lie flat on the end surface of the bottle top while the bottles 4 are held by the centering head. By means of a guide element 7 projecting into the transport path 5, the bottles, after being released from the axial bracing, are transferred from their receiving positions in the turntable 1 to receiving positions 8 on the outside circumferences of the delivery star wheel 2, and are held by the guide element 7 over the remaining transport distance into the receiving positions 8 until they are delivered onto a plate or platform conveyor belt 3. So that the bottles 4 do not slip inside the receiving positions 8, these receiving positions 8 are lined with non-slip elements.

In segment 9 of the transport path of the bottles 4, which forms the transition between the transport path 5 in the turntable 1 and the transport path 10 in the delivery star wheel, there is a fixed folding element 11, which as each bottle passes, folds back the peak of the foil sheet 6 projecting beyond the top of the bottle. For each receiving position 8, there is a pressing element 12 as shown schematically in FIG. 1, which is located in different radial positions as a function of its position on the circulation path 10. In the vicinity of the turntable 1 it is in its inside position, so that a collision-free passage is possible on the turntable 1, in particular past its centering elements, while in the segment between the turntable 1 and the delivery, it is in its radially outside position As FIG. 1 shows, the activation begins very early, namely as far back as in the vicinity of the folding mechanism 11.

Figure 2:
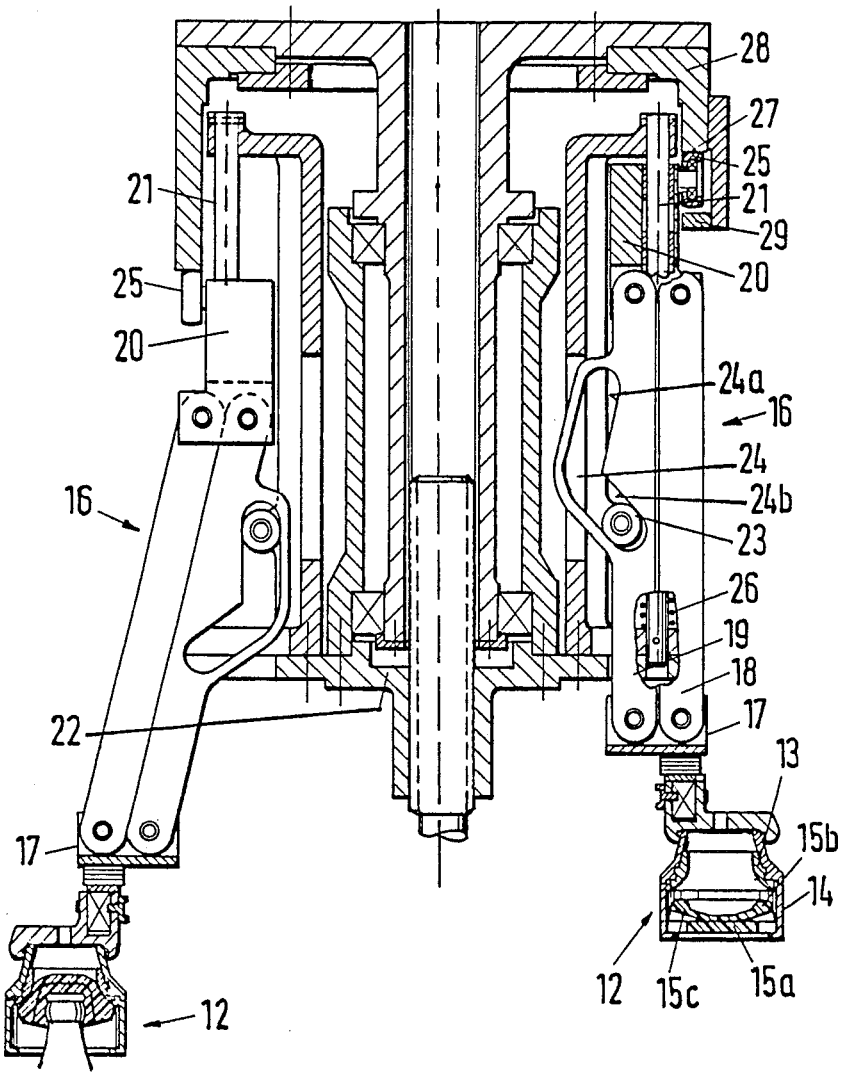
FIG. 2 shows a support with pressing elements in an axial section along line I—I in FIG. 1.
Figure 3:
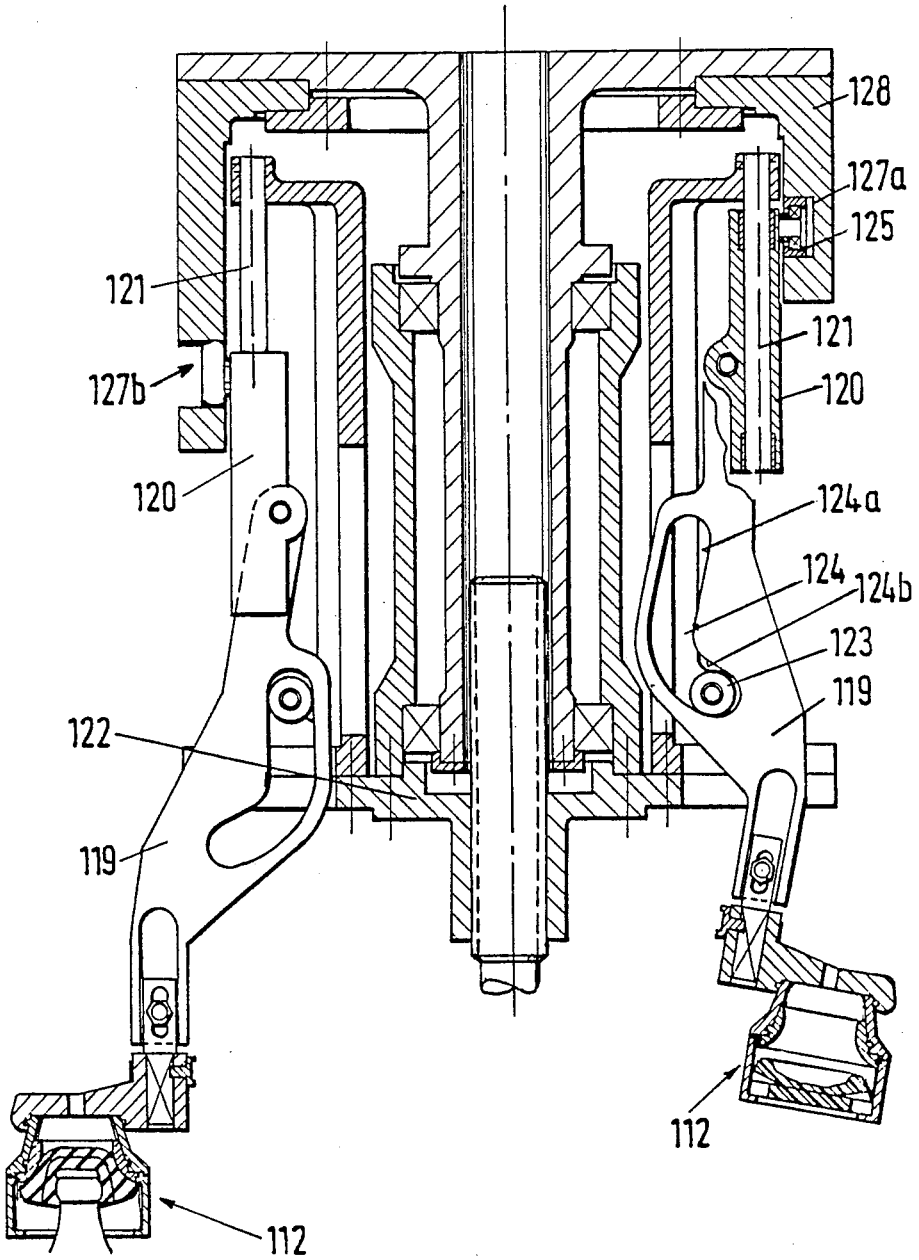
FIG. 3 shows a support with pressing elements in an axial section along line I—I in FIG. 1, in a model which is different from the one illustrated in FIG. 2.
Figure 4:
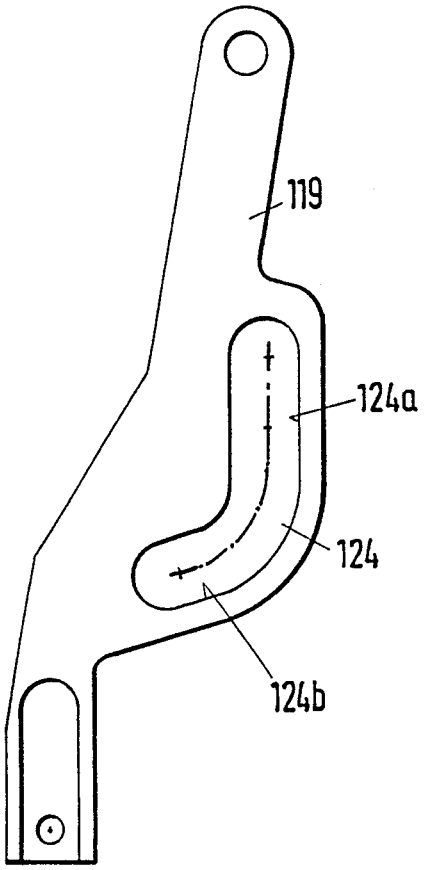
FIG. 4 shows the rocker of the three-dimensional cam drive mechanism illustrated in FIG. 3, in a side view.
Figure 5:
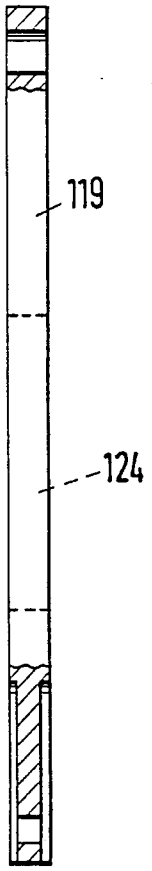
FIG. 5 shows a front view of the rocker illustrated in FIG. 4, with portions broken away to show certain details.

In FIG. 2, on the left, the pressing element 12 is shown in the lower, radially outside position, and on the right, in the upper, radially inside position. The pressing element 12 consists of a bell-shaped housing 13 and a two-layer plate 15*a*, 15*b* held in front of the opening of the housing 13 by means of a support ring 14. The plate 15*a*, 15*b* has a ring-shaped bulge 15*c* on its back side, and is supported with its ring-shaped bulge 15*c* against the bell-shaped inside wall of the housing 13. The plate 15*a*, 15*b* has ribs running radially to the peripheral edge, in the undeformed state enclosing spaces between them, which in the deformed state are in non-overlapping contact in the top and neck area of the bottle 4. Such a pressing element or a similar one is the object of German Laid Open Patent Application No. P 37 20 529.3 and German Patent Application No. P 37 28 958.6. All of the patent applications cited herein are incorporated by reference as if the entire contents thereof were fully set forth herein.

The pressing element 12 is supported by a duplex crank 16 designed as a parallel crank, and in particular by its coupling element 17. The two rockers 18, 19 of the duplex crank 16 are supported by its fixed link 20, which is mounted on two parallel guide rods or rails 21 (shown) so that it will not rotate or pivot, but so that it can be displaced axially. The rails 21 are held in a support 22, which is mounted on the delivery star wheel 2 and is driven jointly with the latter. An engagement element 23 of a cam drive mechanism is also mounted in the support 22 so that it can rotate, and includes a slot cam 24 on the rocker 19. The slot cam 24 comprises two segments 24*a*, 24*b*. Segment 24*a* is used for the axial movement, and segment 24*b* for a combined axial and radial movement of the pressing element 12.

The fixed link 20 supports, as the engagement element of a three-dimensional cam drive mechanism, a roller 25, which is pressed by means of a spring 26 acting on the fixed link 20 against a corresponding cylinder cam 27, which is supported by a frame 28 which does not rotate. There is a support element 29 opposite the cylinder cam 27, primarily in the region of the turntable 1, to prevent the pressing element 12 from moving under its own weight, if the spring 26 breaks, from the inside radial position shown on the right in FIG. 2 to the outside radial position shown on the left.

During operation, the pressing elements 12 reach the top inside radial position in the region adjoining the turntable 1. In this position they lie outside the area traversed by the centering heads, which are still active here. As soon as the centering heads are raised and the bottles 4 are released by the guide element 7 for their transfer to the delivery star wheel 2, the three-dimensional cam drive mechanism 25, 27 lowers the duplex crank 26 with the pressing element 12. During this descending movement, on account of the curvature of the segment 24*b* of the slot cam 24, there is a radial movement of the pressing element 12 outward, until the end of this segment is reached. As the descent continues, then, the rest of the movement is an axially parallel descent, because in this movement segment, the segment 24*a* of the slot cam runs parallel to the descent produced by the rails 21. During this second segment of the movement, the rockers 18, 19 are already in contact with one another and brace one another. Therefore they absorb the reaction force which occurs during pressing, without transmitting this force to the cam drive mechanism 23, 24. Shortly before the delivery on the platform or plate conveyor belt 3, the duplex crank 16 is again raised, so that the bottles 4 with foil pressed on all sides can be transferred to the platform or plate conveyor belt 3.

The embodiment illustrated in FIGS. 3 to 7 is the same as the embodiment illustrated in FIG. 1, except for the supports of the cams and the rockers. Identical parts have therefore been identified by the same number, plus 100. The support of the three-dimensional cam drive mechanism 128 is designed as a cylindrical drum. Its cam comprises a flat curve segment 127*a* lying in a radial plane, and a three-dimensional cam segment 127*b* which extends over several radial planes. The plane cam segment 127*a* is designed as an closed slot cam, while the three-dimensional cam segment 127*b* is designed as an open slot cam. In this cam 127*a*, 127*b*, a roller 125 is guided as the engagement element of a fixed link 120 of a rocker 119. The fixed link 120 is mounted on two parallel rails or guide rods 121 (shown) so that it cannot rotate or pivot, but so that it can move axially. On the free end of the rocker 119 designed as a one-armed lever, a pressing element 112 is rigidly mounted, so that the pressing element 112 is oriented diagonally in the raised position, and in the lowered position, its axis is parallel to the axis of the bottle.

As in the embodiment illustrated in FIG. 2, the cam 124 of the rocker 119 consists of two cam segments 124*a*, 124*b*, where the cam segment 124*b* causes the radial movement and the cam segment 124*a* the axially parallel guidance during lowering. The cam segment 124*b* on the one hand and the three-dimensional cam segment 127*b* of the three-dimensional cam drive mechanism on the other hand are matched to one another, so that during the transition from the flat cam segment 127*a* into the three-dimensional cam segment 127*b*, when the descending movement is still small in relation to the rotational movement, the degree of radial deflection caused by the cam segment 124*b* is large and becomes smaller with increasing axial movement. In this manner, the load on the cams is made more uniform. This arrangement of the curves of the cams is not limited to the embodiment illustrated in FIG. 3, but can also be used in the embodiment illustrated in FIG. 2.

Figure 6:
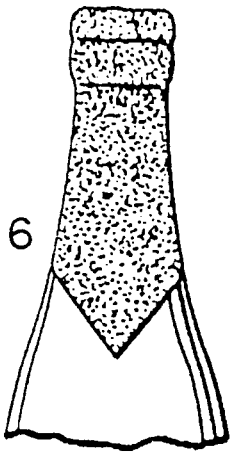
FIGS. 6 and 7 show a partial front elevational view of bottles with labels attached by the apparatus of the present invention.
Figure 7:
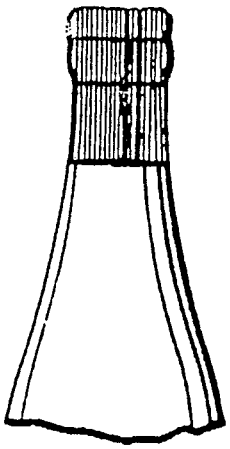
Figure 8:
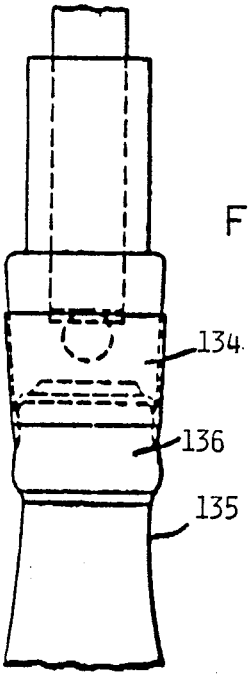
FIG. 8 shows a partial front elevational view of a bottle which is engaged by the apparatus of the present invention.

Shown in FIG. 8 is a typical centering head 134 having a slightly trunconical outer periphery and which, at the bottom, has a diameter that is the same as the diameter of the bottle top 136, while at its upper part it has a slightly larger diameter. Also shown is a foil patch or sheet 135 which may be pressed in the apparatus of this invention to have a finished appearance, such as shown in FIGS. 6 and 7.

In summing up, one aspect of the invention resides in a pressing station for metal foil sheets 6 applied around the top and neck of bottles 4 in a labelling machine with a transfer station located on the turntable 1 for the bottles 4 which transfers the metal foil sheets 6 to the bottles 4. Also included is a delivery star wheel 2, in which corresponding to each receiving spot 8 for the bottles 4 located on its circumference, there is a bell-shaped pressing element 12, 112 which can be moved by a cam controlled drive mechanism axially toward the bottle top. The pressing element 12, 112 is held by a support 22, 122 located above the delivery star wheel 2 which rotates with the delivery star wheel 2. The pressing element 12, 112 is supported on the free end of a rocker 19, 119 which can be adjusted in an axial plane. The other end is moved axially during the rotation of the pressing element 12, 112 around the axis of the delivery star wheel 2 by a three-dimensional cam drive mechanism 25, 27, 125, 127*a*, 127*b*, and the free end is moved radially by a cam drive mechanism 23, 24, 123, 124 coupled with the rocker 19, 119, as a function of the axial movement of the rocker 19, 119. The cams 24, 27, 124, 127 of the two cam drive mechanisms 23, 24, 25, 27, 123, 124, 125, 127 are designed so that the pressing element 12, 112 is in its raised inside position in the vicinity of the turntable 1 and is in its lower outside position in a portion of the region between the turntable 1 and the delivery of the delivery star wheel 2. The cam 24, 124 of the cam drive mechanism 23, 24, 123, 124 is coupled with the rocker 19, 119 which comprises several segments 24*a*, 24*b*, 124*a*, 124*b*. Its first segment 24*b*,124*b* is active during the downward movement and has at least one radial control component and the segment 24*a*, 124*b* which is active during the pressing of the foil sheet has only one axial component. The cams 124, 127 of the two cam drive mechanisms 23, 24, 25, 27, 123, 124, 125, 127 are designed so that an initially slow descending movement of the rocker 19, 119 corresponds to a large radial movement. The cam 27, 127 of the three-dimensional cam drive mechanism 25, 27, 125, 127 lies on a drum jacket surface, in particular one which is cylindrical. The cam located on the drum jacket surface of the three-dimensional cam drive mechanism 25, 27, 125, 127 is designed as a support cam for the engagement element 25, 125 of the three-dimensional cam drive mechanism 25, 27, 125, 127, which absorbs the axial reaction force of the pressing element 12, 112 on the bottle top. The rocker 19 is part of a duplex crank 16, whose coupling element 17 supports the pressing element 12 and whose fixed link 20 is axially moved by the three-dimensional cam drive mechanism 25, 27. The duplex crank 16 is a parallel crank. The rockers 18, 19 of the duplex crank 16 are braced against one another in their outside radial position. The rocker 119 is designed as a one-armed lever, to which the pressing element 112 is rigidly fastened. The rocker 19 is pre-stressed by a spring 26, which presses the contact element 25 of the three-dimensional cam drive mechanism 25, 27 against the support cam 27. The cam 127 of the three-dimensional cam drive mechanism 125, 127 has a plane cam segment 127*a* which lies a radial plane, and a three-dimensional cam segment 127*b* which extends over several radial planes, and is designed on the inside as a drum-shaped support, whereby the plane curve segment 127*a* is designed as a closed slot cam, and the three-dimensional cam segment 127*b* is designed as a radially open slot cam.

The invention as described hereinabove in the context of a preferred embodiment is not to be taken as limited to all of the provided details thereof, since modifications and variations thereof may be made without departing from the spirit and scope of the invention.

What is claimed is:

1. A method for pressing and attaching foil sheets around the top and neck of bottles comprising:

transporting said bottles and foil sheets along a predetermined path of travel to a transfer station;

transporting said bottles and foil sheets along a predetermined path of travel from said transfer station to a pressing station;

moving foil pressing means in a movement at least a portion of which is a combined simultaneous axial and radial movement with respect to said path of travel of said bottles from said transfer station to said pressing station, from a retracted position out of said predetermined paths of travel to an extended position above said top of said bottles; and moving said foil pressing means in a movement at least a portion of which is an axial movement only with respect to said path of travel of said bottles to said pressing station to press and attach said foil sheets around the top and neck of said bottles.

2. Apparatus for pressing and attaching foil sheets around the top and neck of bottles comprising:

means for transporting said bottles and foil sheets along a predetermined path of travel to a transfer station;

means for transporting said bottles and foil sheets along a predetermined path of travel from said transfer station to a pressing station;

means in said pressing station for pressing said foil sheets around the top and neck of said bottles;

said means for pressing said foil sheets including operative means for moving said foil pressing means in a movement at least a portion of which is an axial movement only with respect to said path of travel of said bottles from said transfer station to said pressing section;

said operative means for moving said foil pressing means being mounted on a rotatable support; and said operative means for moving said foil pressing means also provides movement at least a portion of which is a combined simultaneous axial and radial movement which respect to said path of travel of said bottles from said transfer station to said pressing station, from a retracted position out of said predetermined paths of travel to an extended position above said top of said bottles.

3. Apparatus according to claim 2, wherein said means for transporting bottles and foil sheets to said transfer station overlaps said means for transporting said bottoms and foil sheets to said pressing station.

4. Apparatus according to claim 3, wherein said means for transporting bottles and foil sheets to said transfer station includes means that grip the top of the bottles during said transferring to said transfer station.

5. Apparatus according to claim 3, wherein said predetermined path of travel to said transfer station and said predetermined path of travel to said pressing station are both arcuate paths.

6. Apparatus according to claim 3, wherein said operative means for moving said pressing means from a retracted position to an extended position includes a rocker arm mechanism having an integral slot cam.

7. Apparatus according to claim 6, wherein said rocker arm mechanism comprises a duplex crank.

8. Apparatus according to claim 6, wherein said rocker arm mechanism comprises a one-armed lever.

9. Apparatus according to claim 6, wherein said rocker arm mechanism is operatively connected to a three-dimensional cam drive mechanism.

10. The pressing station according to claim 2, wherein said means for transporting said bottles and foil sheets along a predetermined path of travel from said transfer station to a pressing station further comprises means for transporting said bottles along a circular path of travel, said circular path of travel comprising a substantial portion of a circle.

11. A labelling machine for applying labels to bottles, said labelling machine comprising:

a label transfer station;

a turntable having said label transfer station located along said turntable, said label transfer station for transferring labels to the bottles;

a delivery star wheel having receiving portions at the periphery thereof for receiving the bottles from said turntable;

a pressing element being movable axially toward a bottle, said pressing element being held by a rotatable support located above said delivery star wheel, said support for rotating with said delivery star wheel;

two dimensional cam means;

three dimensional cam means;

rocker means movably supported by said three dimensional cam means and connected to said two dimensional cam means;

said rocker means for supporting said pressing element;

said rocker means being movable in an axial plane during movement of said pressing element;

said rocker means being movable on said three dimensional cam means;

said rocker means being movable in a radial direction by said two dimensional cam means during said axial movement of said rocker means;

said two dimensional cam means having first surface means and second surface means;

said first surface means of said two dimensional cam means for allowing movement at least a portion of which is a combined simultaneous axial and radial movement of said pressing element when said rocker means moves in said axial plane; and said second surface means for allowing only axial movement of said pressing element when said rocker means moves in said axial plane, whereby said two dimensional cam means and said three dimensional cam means cause said pressing element to be in a raised and radially inward position with respect to the surface and axis of rotation of said turntable and to be in a lowered and radially outward position with respect to the surface and axis of rotation of said turntable.

12. The labeling machine according to claim 11, wherein said two dimensional cam means and said three dimensional cam means are configured so that an initially slowed descending movement of said rocker means corresponds to a large radial movement.

13. The labelling machine according to claim 12, wherein said cam of said three dimensional cam means lies on a cylindrical drum jacket surface.

14. The labelling machine according to claim 13, wherein said cam of said three dimensional cam means is configured as a support cam for an engagement element of said three dimensional cam means which absorbs axial reaction forces of said pressing element on said bottle.

15. The labelling machine according to claim 14, further including duplex crank means comprising said rocker means, said duplex crank means including coupling means supporting said pressing element and having a fixed link which is axially moved by said three dimensional cam means.

16. The labeling machine according to claim 15, wherein said duplex crank means is parallel crank means.

17. The labeling machine according to claim 16, wherein said first and second rocker means are braced against one another when said pressing element is in its radially outward position.

18. The labeling machine according to claim 17, wherein said rocker means is configured as a one-armed lever to which said pressing element is rigidly fastened.

19. The labelling machine according to claim 18, wherein said rocker means is prestressed by a spring which presses the contact element of said three dimensional cam mechanism against its support cam.

* * * * *

UNITED STATES PATENT AND TRADEMARK OFFICE

CERTIFICATE OF CORRECTION

PATENT NO. : 4,976,803

DATED : December 11, 1990

INVENTOR(S) : Josef TOMASHAUSER, Rudolf ZODROW and Rainer BUCHHOLZ

It is certified that error appears in the above-identified patent and that said Letters Patent is hereby corrected as shown below:

Title page:

In the caption of the patent, where the first named inventor's last name is indicated, please delete "Tomashauer" and insert --Tomashauser--.

In the Inventors section, indicated by the INID code [75], after 'Josef', delete "Tomashauer" and insert --Tomashauser--.

In column 2, line 16, after 'no', delete "daming" and insert --damming--.

In column 3, line 25, after 'movement', insert --.--.

In column 5, lines 67-68, after 'position', insert --.--.

In column 7, line 6, after 'to', delete "7" and insert --5--.

UNITED STATES PATENT AND TRADEMARK OFFICE

CERTIFICATE OF CORRECTION

PATENT NO. : 4,976,803

DATED : December 11, 1990

INVENTOR(S) : Josef Tomashauser, Rudolf Zodrow and Rainer Buchholz

It is certified that error appears in the above-identified patent and that said Letters Patent is hereby corrected as shown below:

In column 9, line 39, after the first instance of 'said', delete "bottoms" and insert --bottles--.

Signed and Sealed this

Twenty-eighth Day of April, 1992

*Attest:*

HARRY F. MANBECK, JR.

*Attesting Officer*

*Commissioner of Patents and Trademarks*